United States Patent [19]

Prestel et al.

[11] Patent Number: 5,016,140

[45] Date of Patent: May 14, 1991

[54] SWITCH ARRANGED FOR BEING MOUNTED ON A CIRCUIT BOARD

[75] Inventors: Fritz Prestel, Hausen a. Tann; Martin Lohner, Balingen-Ostdorf, both of Fed. Rep. of Germany

[73] Assignee: BSG-Schalttechnik GMBH & Co. KG, Balingen, Fed. Rep. of Germany

[21] Appl. No.: 391,417

[22] Filed: Aug. 8, 1989

[30] Foreign Application Priority Data

Aug. 30, 1988 [DE] Fed. Rep. of Germany ..... 3829301

[51] Int. Cl.[5] ..... H05K 7/02

[52] U.S. Cl. ..... 361/400; 200/459; 200/460; 200/463; 200/467; 361/405

[58] Field of Search ..... 200/292, 450, 453, 459, 200/460, 463, 467; 361/400, 405–406

[56] References Cited

U.S. PATENT DOCUMENTS 3,585,557 6/1971 Jorgensen ..... 200/459

4,603,242 7/1986 Atsumi et al. ..... 200/459

FOREIGN PATENT DOCUMENTS 2802133 5/1985 Fed. Rep. of Germany .

*Primary Examiner*—Gregory D. Thompson

*Attorney, Agent, or Firm*—Darby & Darby

[57] ABSTRACT

For the purpose of mounting a switch on a circuit board and of actuating the switch, it is proposed that the biassing spring biassing the wiper into a first above dead-center position be pivoted at the same main mounting part on which the wiper is supported, that a rod be arranged to pass through the circuit board in a direction perpendicular to the direction of the wiper movement, and that the rod be seated in such a manner that it comes to bear upon the central area of the biassing spring so as to displace the latter relative to the pivot point of the spring on the wiper in such a manner that the wiper is moved into a second switching position for the time during which such action persists.

11 Claims, 1 Drawing Sheet

SWITCH ARRANGED FOR BEING MOUNTED ON A CIRCUIT BOARD

BACKGROUND OF THE INVENTION

The present invention relates to a switch arranged for being mounted on a circuit board (printed circuit board) and a device for actuating such switch, according to the preamble of claim 1.

In the case of a known tumbler switch of this type, which has been described by DE-PS 28 02 133, the mounting parts which support counter-contact elements located in the area of movement of the wiper and simultaneously also the wiper, are mounted directly on a first surface of the circuit board and provided with extensions which are soldered to conducting paths present on the bottom face of the circuit board, on the one hand for fixing the mounting parts mechanically and on the other hand for ensuring the electric connection to such conducting paths. This arrangement makes it possible to build up a tumbler switch with biassing spring from a small number of parts, the circuit board serving simultaneously as sort of a housing, in any case as support, for the switch structure. However, it is a problem of this arrangement that means must be provided which make it possible to actuate the switching movement of the wiper from the outside in a suitable manner. One has provided to this end a separate actuating element, which is supported on the circuit board separate from the mounting parts and which, being itself pivotallY mounted, is capable of changing the position of the biassing spring which is connected to its other end, in such a manner relative to the pivot point of the wiper that different above dead center positions of the wiper and, consequently, engagement of different counter-contact elements is rendered possible, depending on the position of the external actuating element. Certain problems are connected, hoWever, with the transmission of the external switching forces to the actuating element Which then reverses the Wiper via the biassing spring; given the fact that the circuit board is a flat body, external switching forces will normally act upon the actuating elements in a direction parallel to such body, and there will always be a risk that the actuating element mounted on the circuit board may be dislodged from its position or tilted in some other manner.

Now, it is the object of the present invention to provide a switch of particularly simple design in the form of an ON/OFF switch or a double-throw switch, which is likewise mounted directly on a circuit board serving as supporting housing element and which can be actuated without any problem by means of a simple, separately mounted rod so that the whole switch can be accommodated within very confined space.

ADVANTAGES OF THE INVENTION

The invention achieves this object with the aid of the characterizing features of the main claim and provides the advantage that, due to the switch being actuated from below through an opening in the circuit board which serves as support for the switch components, it is possible to use an actuating element of particularly simple design which is capable of moving the wiper in the manner of a tumbler switch, without the need to accommodate or support the biasing spring itself, and which ensures—this feature is of particular importance—that the simple rod forming the actuating element acts upon the biasing spring directly and vertically in relation to the circuit board, thereby causing the wiper to move in a plane vertical to the circuit board, rather than in a plane parallel to the latter.

As other circuit components that are to be accommodated or to be mounted additionally on the circuit board always require a certain vertical clearance on the equipment side of the circuit board, this clearance may be utilized also for the wiper movement so that a switch of this type does not require much space on the circuit board as such.

The switch design according to the invention is particularly well suited for circuit boards of the type which are inserted and sealed in a sealed housing accommodating the circuit board, in which case the housing may at the same time perform certain guiding functions in the area of the switching rod. The switch is then actuated by the rod from the bottom of the frame, through the sealing frame and the circuit board. The features specified by the sub-claims permit advantageous developments and further improvements of the invention. A particularly advantageous solution is obtained by the possibility to cover or surround the switch components mounted on the circuit board by an additional housing Which does not, hoWever, serve any supporting or bearing functions for the switch components, but only an enclosing and protective function. Furthermore, the switching rod may be sealed by means of a sealing bushing in order to protect the Whole structure from humidity, penetrating dirt particles, and the like, so as to make the structure suited as electronic circuit component for devices of any type, in particular for electric hand tools. Another advantage is seen in the possibility that the main mounting component, the wiper and the biassing spring can be pre-assembled due to the fact that the wiper engages projecting corner edges of lateral legs of the mounting part and cannot get dislodged by the action of the spring.

BRIEF DESCRIPTION OF THE DRAWING

One embodiment of the invention will be described hereafter in more detail with reference to the drawing in which.

DETAILED DESCRIPTION OF THE DRAWINGS

The basic idea of the present invention consists in designing the switch, which is mounted on a circuit board, in such a manner that the movement of a rod in a direction vertical to the circuit board has the effect to move the wiper into its other above dead center position, by direct engagement of the biassing spring, the switching rod being passed through the circuit board from the bottom of the frame and, if necessary, also through a sealing frame accommodating the circuit board on which it is supported for displacement.

Figure 1:
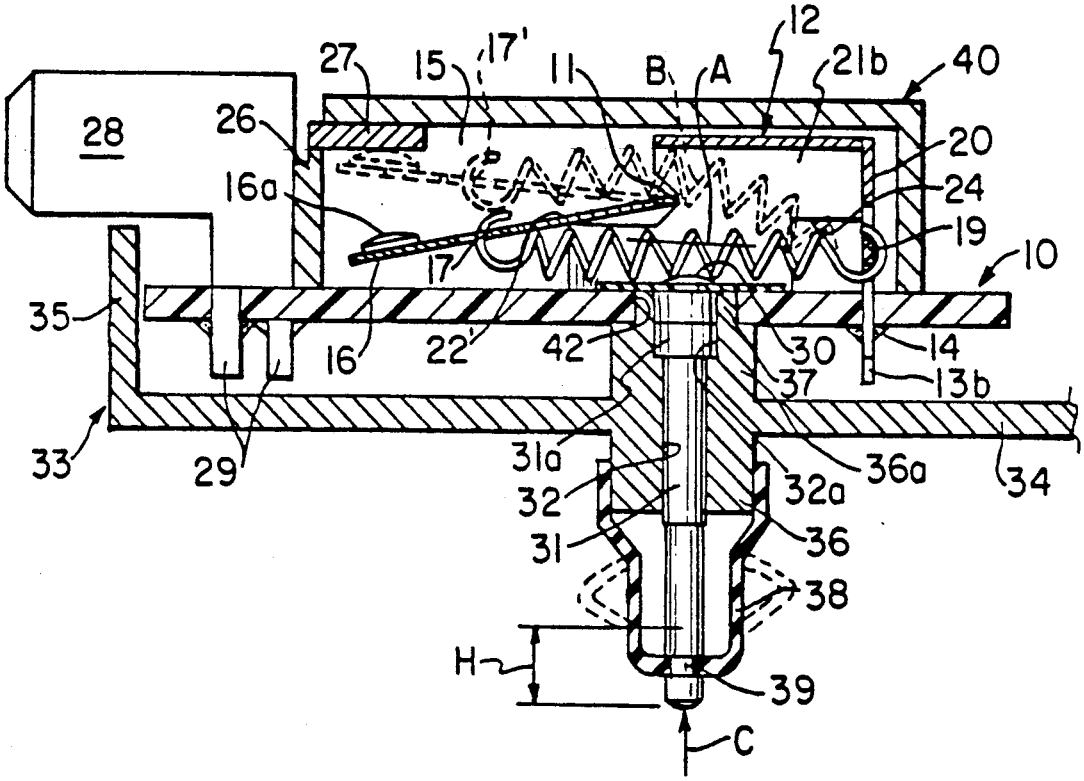
FIG. 1 is a very diagrammatic cross-sectional representation of the structure of a switch according to the invention, including the actuating means, a housing enclosing the switch and a sealing housing accommodating the circuit board.

The representation of FIG. 1 shows only part of a circuit board and the sealing frame supporting it, the part shown being that which supports the switch according to the invention. The circuit board is indicated generally by reference numeral 10, the switch by reference numeral 9. The switch comprises a main supporting or mounting part 12, which is shown once more in enlarged scale in FIG. 2 and which exhibits a generally horse-like structure which will be described in more detail further below. This main mounting part 12 of generally U-shaped configuration comprises extensions 13*a*, 13*b* which are to be passed through matching bores or openings of the circuit board 10 up to the latter's conductor surface and slightly beyond the latter. This enables the extensions 13*a*, 13*b* to be fixed by soldering, as indicated at 14, whereby the main supporting part can be fixed securely on the circuit board and can simultaneously be connected electrically to the connections on the conductor side.

The main mounting part 12 seats simultaneously, in a recessed opening 15, the wiper 16 which is shown in FIG. 1 in the two positions that can be assumed by it. The wiper 16 is engaged at pivot point 17 by a biassing spring 18 whose other end is passed at pivot point 19 through a rear opening in the rear wall of the mounting part and fixed to the latter.

Figure 2:
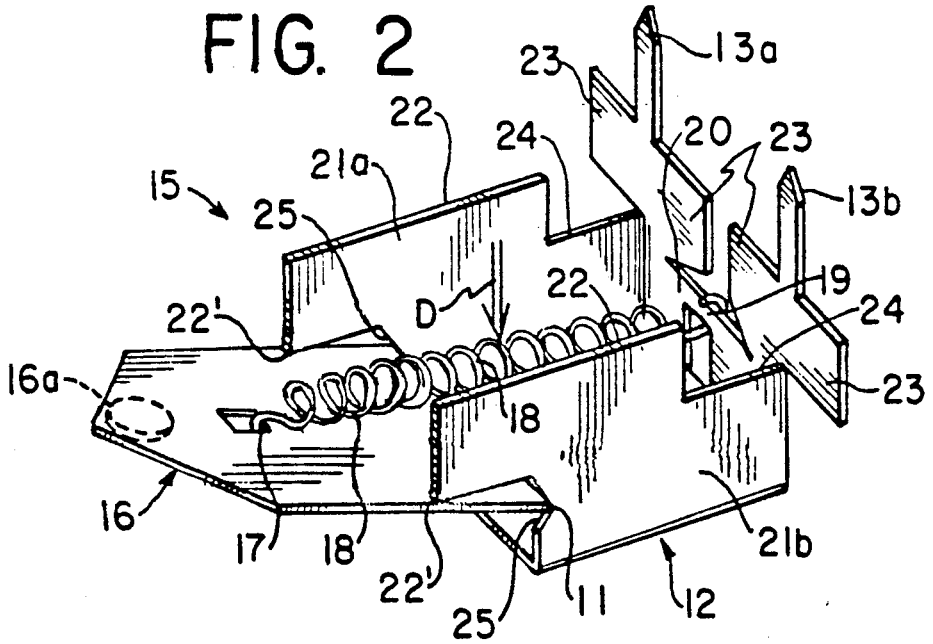
FIG. 2 is a diagrammatic perspective representation of the main mounting part, viewed from the bottom.

The structure of the main mounting part 12 is shown in more detail in FIG. 2. It comprises a rear wall 20, two side walls 21*a*, 21*b* extending from the said rear wall 20 to the left—as viewed in the drawing—in parallel and spaced arrangement so that an altogether U-shaped structure is obtained. It should be noted in this connection that FIG. 2 shows the main mounting part 12 in reversed position, compared with the illustration of FIG. 1, i.e. viewed from the bottom. It will be noted that the two side walls 21*a*, 21*b* form lower longitudinal edges 22 by which the main mounting part 12 is supported on the circuit board 10. Opposite the edges, forward corner stops 22' are provided (on both sides) which in the pre-assembled condition of the main mounting part, i.e. the part described here including the wiper and the biasing spring, are engaged by the wiper which is held by them in this position until assembly with the circuit board.

Correspondingly, the before-mentioned extensions 13*a*, 13*b* project from the rear wall 20 and are provided, adjacent the rear wall, with wing-like enlargements 23 projecting on both sides thereof and serving likewise as stop surfaces for the circuit board 10. It will be seen easily that this main mounting part is made from a flat punched part, the two outer wing-like enlargement 23 consisting of the pieces cut out from the recesses 24 in the side wall.

At the front, the side walls are provided with a recess 25 in the form of the hollow of a knee, which recesses form the bearing support for the wiper 16 so that the latter can be pivoted about this supporting point relative to the main mounting part 12.

Another mounting part 26 forms at 27 the counter-contact for the contact 16*a* at the wiper 16. The main mounting part 12 and the other mounting part 26 consist preferably of a suitable, electrically conductive metal. The other mounting part 26 carrying the counter-contact 27 may additionally comprise a contact connection lug 28 integrally formed therewith. In any case, the other mounting part 26 is also provided with downwardly projecting extensions or projections 29 serving for fixing the mounting part in passage openings arranged in the circuit board 10 and for soldering them to the opposite side thereof.

In the initial position illustrated in FIG. 1, in which the biassing spring occupies its first position in which it has the shortest length and extends along a straight line, as indicated by A, the pivot point 17 of the spring at the wiper 16 and the other pivot point 19 at the rear wall 20 of the main mounting part 12 are positioned at about the same level and below the supporting and pivot point or bearing point 11 of the wiper 16 formed by the recesses 25 in the side walls 21*a*, 21*b*. The described position, therefore, is a stable dead-center position; the wiper movement to the other wiper position, in which the wiper engages the counter-contact 27, is then effected by exerting pressure upon the spring at 30, in the view of the drawing of FIG. 1 from below, so that the spring starts to bulge upwardly and assumes finally the second end position indicated by B, in which the central area of the biassing spring 18 is positioned above the bearing point 11 of the wiper 16 so that—given the fact that the other end of the spring is pivoted at the rear wall 20 in a fixed position at pivot point 19—this displacement of the spring causes the wiper to move upwardly whereby the pivot point of the spring at the wiper 16 comes to occupy the position indicated by 17'.

The switch remains in this position until the spring 18 is pushed down.

For the purpose of effecting this reversing movement by spring action, a rod 31 is provided which is passed through the circuit board 10 in vertical direction and provided, for example, with an enlarged end portion 31*a* which engages a central area of the biassing spring 18—in the illustration of FIG. 1 from below—and urges it into its bulged position indicated at B when further pressure is exerted.

Preferably, the rod 31 is guided in a stepped guide bore 32 in a sealing frame 33 accommodating the circuit board 10. The sealing frame 33 comprises a bottom plate 34, for example with an integrally formed rim 35 intended for receiving the sealing compound, the guide bore 32 for the rod 31 being arranged in an enlargement 36 extending upwardly and downwardly from the bottom plate 34 of the sealing frame 33.

The projection 36*a* of the enlargement 36 extending upwardly, i.e. towards the circuit board 10, may be provided with an upper narrower annular projection 37 passing through the bore 42 in the circuit board 10 so that the latter is also fixed provisionally relative to the sealing frame 33 and held safely in place during assembly, the enlarged end 31*a* being received in a separate, enlarged portion 32*a* of the guide bore 32 for the rod 31.

The bias of the spring in its initial position A urges the rod 31 automatically outwardly and gives it a sufficient amount of prestress. By pressing the rod in the direction of arrow C, which corresponds to the exertion of a force on the biassing spring 18 at about its center, in the direction indicated by double arrow D in FIG. 2, one then obtains a suitable external actuating mechanism, whereby the rod is caused to move over a stroke H until the wiper is thrown over and assumes the ON condition which, in the case of the simple ON/OFF switch implemented by this embodiment of the invention, is marked by the engagement of the counter-contact 27.

It may be recommendable to seal the rod 31 on its outside by an elastic sealing bushing 38 which may, for example, consist of rubber or another suitable elastomer and which is fitted tightly on the lower portion of the enlargement 36 in the form of an outer bandage, which tapers towards the end of the rod and engages an annular recess 39 in the rod. When the rod is actuated, the sealing bushing then bulges outwardly as indicated in the drawing by broken lines.

According to another embodiment of the present invention, the switch components may, if desired, be enclosed by an additional (partial) housing which is open at its bottom, i.e. on the side facing the circuit board 10). Such a housing is indicated at 40; it exhibits a generally box-like form and may be mounted on the circuit board using conventional snap-on means, for example in the form hook-like projections passing through the circuit board.

Finally, additional electronic elements that are to be arranged on the circuit board for completing the intended structure, for example a control component intended for controlling the speed of machine tools, or the like, can be sealed in simultaneously, the housing 40 preventing any sealing compound from penetrating into the area of the switch.

The rod 31 may then be actuated in any desired manner, for example and preferably by means of a slide which is part of the unit in which the component is to be mounted, the slide acting on the rod, for example, by a movable surface which rises gradually in the vertical plane and which causes the rod to move upwardly in the plane of FIG. 1. The sealed, finished component may then be installed—as indicated by the sectional representations of the figures—in any unit to be equipped correspondingly, and may be fixed to the latter in such a manner that the associated slide provided on such unit is capable of actuating the rod as described.

All features shown in the drawing and described in the specification and the following claims may be essential to the invention either alone or in any combination thereof.

We claim:

1. A switch arranged to be mounted on a circuit board comprising a movable wiper and at least one counter-contact arranged in the area of movement of said wiper, said wiper movable between a first above dead-center position and a second switching position to contact said counter-contact, a biassing spring engaging said wiper and generating a biassing force, an actuating element adapted to be operated by external switching means, and a main support on which said wiper is supported, said main support being placed directly on said circuit board and fixed thereon, characterized in that (a) said biassing spring is mounted on said main support and on said wiper, said biassing spring, supporting said wiper and operable to bias said wiper into said first above dead-center position, (b) said actuating element comprising a rod passing through said circuit board in a direction parallel to the direction of movement of said wiper; and (c) wherein said rod is positioned to bear vertically upon a central area of said biassing spring to displace said central area of said spring to move said wiper from said first position to said second switching position.

2. A switch according to claim 1, wherein the circuit board comprises an equipment side and a conductor side, said main support, said wiper, said biassing spring and a second support which carries the counter-contact are arranged on the equipment side of said circuit board, a pair of extensions of said main and second supports project through said circuit board to the conductor side and are fixed to said circuit board by soldering.

3. A switch according to claim 1, wherein in the first position, said biassing spring extends parallel to said circuit board and its contact point with said wiper and said main support are located in a plane extending below a plane of a pivot point of said wiper.

4. A switch according to claim 1, wherein the wiper moves in a plane perpendicular to the plane of said circuit board, wherein in said first position said biassing spring is in a substantially straight extended position, and said rod extending vertically through a bottom portion of said circuit board and moves the spring upwardly from said first position to a second position to pivot said wiper upwardly, so it is brought into engagement with said counter-contact.

5. A switch according to claim 2, further comprising a sealing housing receiving said circuit board, said sealing housing having an enlarged portion forming a guide for the rod for maintaining said rod directed upon and in alignment with said biassing spring.

6. A switch according to claim 5, wherein said guide has a stepped contour with an enlarged diameter at its upper end arranged for receiving a head of said rod.

7. A switch according to claim 1, wherein an end of said rod is sealed by a sealing bushing.

8. A switch according to claim 7, wherein said sealing bushing seals said end of said rod which projects beyond said enlarged portion to enclose said enlarged portion tightly in the form of a bandage, said sealing bushing engages an annular recess provided at a lower end of said rod.

9. A switch according to claim 1, wherein said main support has a generally U-shaped form comprising a rear wall and a pair of side walls formed integrally therewith, said side walls being provided on both sides with undercut portions forming a bearing point for said wiper, said biassing spring being pivoted on said rear wall of said main support.

10. A switch according to claim 9, further comprising a pair of extensions extending from said rear wall in the direction of said circuit board and supported on a surface of the circuit board by offset wing-line enlargements.

11. A switch according to claim 9, wherein said side walls include corner edges forming stops for said wiper for securing said wiper in position in a pre-assembled condition.

* * * * *